US008011373B2

(12) United States Patent
Torikai et al.

(10) Patent No.: US 8,011,373 B2
(45) Date of Patent: Sep. 6, 2011

(54) METHOD OF TREATING TOBACCO EXTRACT SOLUTION TO REDUCE MAGNESIUM IONS AND METHOD OF MANUFACTURING A TREATED TOBACCO MATERIAL

(75) Inventors: Koji Torikai, Yokohama (JP); Hiromichi Muto, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 907 days.

(21) Appl. No.: 11/703,764

(22) Filed: Feb. 8, 2007

(65) Prior Publication Data

US 2007/0137665 A1 Jun. 21, 2007

Related U.S. Application Data

(63) Continuation of application No. PCT/JP2005/015125, filed on Aug. 19, 2005.

(30) Foreign Application Priority Data

Aug. 24, 2004 (JP) ..... 2004-244191

(51) Int. Cl.
*A24B 15/24* (2006.01)

(52) U.S. Cl. ..... 131/297; 131/298; 131/308; 131/309; 131/290

(58) Field of Classification Search ..... None
See application file for complete search history.

(56) References Cited

U.S. PATENT DOCUMENTS

| | | | | |
|---|---|---|---|---|
| 3,616,801 | A | 11/1971 | Hind | |
| 4,131,117 | A | 12/1978 | Kite et al. | |
| 4,289,147 | A * | 9/1981 | Wildman et al. | 131/290 |
| 4,301,817 | A | 11/1981 | Keritsis | |
| 4,364,401 | A | 12/1982 | Keritsis | |
| 4,589,428 | A | 5/1986 | Keritsis | |
| 5,025,812 | A | 6/1991 | Fagg et al. | |
| 5,065,775 | A | 11/1991 | Fagg | |
| 5,131,414 | A | 7/1992 | Fagg et al. | |
| 5,148,819 | A * | 9/1992 | Fagg | 131/297 |
| 5,234,008 | A | 8/1993 | Fagg | |
| 5,339,838 | A | 8/1994 | Young et al. | |
| 5,810,020 | A | 9/1998 | Northway et al. | |

FOREIGN PATENT DOCUMENTS

| | | | |
|---|---|---|---|
| CA | 1001039 | A | 12/1976 |
| GB | 867 528 | A | 5/1961 |
| GB | 991 441 | A | 5/1965 |
| JP | 56-31093 | A | 3/1981 |
| JP | 57-29145 | B2 | 6/1982 |
| JP | 3-83570 | A | 4/1991 |
| JP | 5-7485 | A | 1/1993 |
| JP | 2004-242639 | A | 9/2004 |

OTHER PUBLICATIONS http://www.diaion.com/Diaion_Tables/Diaion_CRtable_R_E.thm (Sep. 30, 2000).*

European Search Report issued Feb. 23, 2010 in Application No. 05780435.3.

Garg et al. "Chelating resins and their applications in the analysis of trace metal ions", Microchemical Journal, vol. 61 , 1999, pp. 94-114, XP002538996.

Schmuckler. "Chelating resins—their analytical properties and applications", Talanta, vol. 12, 1965, pp. 281-290, XP002538995.

* cited by examiner

*Primary Examiner* — Richard Crispino
*Assistant Examiner* — Phu H Nguyen
(74) *Attorney, Agent, or Firm* — Birch, Stewart, Kolasch & Birch, LLP

(57) ABSTRACT

A method of treating a tobacco extract solution includes bringing an extract solution, which is obtained by extracting a natural tobacco material with an aqueous extracting solvent, into contact with a polymer containing, in its side chain, a functional group which traps metal ions including at least magnesium, thereby obtaining an extract solution with an amount of at least magnesium reduced.

3 Claims, No Drawings

METHOD OF TREATING TOBACCO EXTRACT SOLUTION TO REDUCE MAGNESIUM IONS AND METHOD OF MANUFACTURING A TREATED TOBACCO MATERIAL

CROSS-REFERENCE TO RELATED APPLICATIONS

This is a Continuation Application of PCT Application No. PCT/JP2005/015125, filed Aug. 19, 2005, which was published under PCT Article 21(2) in Japanese.

This application is based upon and claims the benefit of priority from prior Japanese Patent Application No. 2004-244191, filed Aug. 24, 2004, the entire contents of which are incorporated herein by reference.

BACKGROUND OF THE INVENTION

1. Field of the Invention

The present invention relates to a method of treating a tobacco extract solution to eliminate magnesium ions, a method of manufacturing a regenerated tobacco material, and a regenerated tobacco material.

2. Description of the Related Art

Tobacco materials such as natural tobacco leaves, tobacco shreds, midribs, stems and roots contain various components including nicotine, proteins, alkali metals and alkaline earth metals. These components are extracted from a natural tobacco material and used as a flavor additive to tobacco. Some of these components of the natural tobacco materials should desirably be reduced in amount or removed, while the others should not be removed or even increased in amount, for a reason of smoking flavor or some other reasons.

For example, U.S. Pat. No. 3,616,801 discloses a method in which the amount of metal ions (magnesium, calcium, potassium, etc.) is reduced from an aqueous tobacco extract solution by bringing a cation exchange resin into contact with the extract, in order to improve the burning property, flavor and ash characteristics of tobacco. It is described that with the addition of the tobacco extract solution having the reduced amount of metal ions to the extraction residue, a regenerated tobacco material with improved burning, flavor and ash characteristics is obtained.

BRIEF SUMMARY OF THE INVENTION

The inventors of the present invention investigated the effect of the components in tobacco leaf shreds on the generation of components in the mainstream smoke of cigarettes, and found that metals present in tobacco leaf shreds, especially, magnesium, promote the generation of, e.g., benzopyrene, hydrogen cyanide, acrolein, nitrogen oxide (NOx) and aminonaphthalene in the mainstream smoke. Therefore, if the metals such as magnesium are eliminated from an extract solution obtained by extracting the tobacco leaf shreds with an aqueous extracting medium, and the metal-eliminated extract solution is added to a regenerated tobacco web obtained using the extraction residue, a regenerated tobacco material with reduced amount of benzopyrene, hydrogen cyanide, acrolein, nitrogen oxide (NOx), aminonaphthalene, etc. can be obtained. However, when such a tobacco extract solution is treated with a cation exchange resin disclosed in the above patent document 1, not only the metals contained in the tobacco extract solution, but also nicotine is significantly eliminated as well.

Therefore, an object of the present invention is to provide a method of treating an extract solution obtained from natural tobacco materials, which method can eliminate metals including magnesium without significantly eliminating the other components, especially, nicotine, from the extract solution, as well as a method of manufacturing a regenerated tobacco material and a regenerated tobacco material.

According to a first aspect of the present invention, there is provided a method of treating a tobacco extract solution, comprising bringing an extract solution, which is obtained by extracting a natural tobacco material with an aqueous extracting solvent, into contact with a polymer containing, in its side chain, a functional group which traps metal ions including at least magnesium, thereby obtaining an extract solution with the amount of at least magnesium reduced.

According to a second aspect of the present invention, there is provided a method of manufacturing a regenerated tobacco material, comprising the steps of: (a) extracting a natural tobacco material with an aqueous extracting solvent to obtain an extract solution containing components of the natural tobacco material and an extraction residue; (b) bringing the extract solution into contact with a polymer containing, in its side chain, a functional group which traps metal ions including at least magnesium, thereby obtaining an extract solution with the amount of at least magnesium reduced; (c) preparing a regenerated tobacco web using the extraction residue; and (d) adding at least a portion of the extract solution with an amount of at least magnesium reduced to the regenerated tobacco web.

Further, according to a third aspect of the present invention, there is provided a regenerated tobacco material manufactured by a method of manufacturing a regenerated tobacco material according to the present invention.

DETAILED DESCRIPTION OF THE INVENTION

The present invention will now be described in more detail below with reference to various embodiments.

The present invention eliminates metals including magnesium from an extract solution obtained by extracting a natural tobacco material with an aqueous extracting solvent, by using a polymer containing, in its side chain, a functional group which traps metal ions including at least magnesium, while suppressing the loss of the other components such as nicotine to a minimum degree.

First, a natural tobacco material is subjected to an extraction treatment by mixing and stirring the natural tobacco material and an extracting solvent.

As the natural tobacco material, tobacco leaves, tobacco shreds, midribs, stems, roots and a mixture of these can be used. As the extracting solvent, an aqueous solvent can be used. The aqueous extracting solvent such as water may be alkaline or acidic. It is also possible to use, as the aqueous extracting solvent, a mixture of water and a water-miscible organic solvent as well. Examples of such an organic solvent include alcohols such as ethanol. These extracting solvents may contain an inorganic salt such as sodium hydroxide dissolved therein. The extraction treatment is usually carried out at room temperature to 100° C. for about 5 minutes to 6 hours.

After the extraction treatment, the resulting extraction mixture is subjected to a separation operation by, e.g., filtration, to separate it into the extract solution and the extraction residue. The extract solution contains water-soluble components in the natural tobacco material, such as metal ions (such as magnesium, calcium, and potassium), inorganic acids (such as phosphoric acid, sulfuric acid, and hydrochloric acid), organic acids (such as malic acid, and citric acid), nicotine, saccharides, amino acids, proteins, etc.

Next, the extract solution obtained by the separation operation is subjected to a metal elimination operation using a polymer containing, in its side chain, a functional group which traps metal ions including at least magnesium. In the present invention, the metal eliminating operation can be carried out by bringing the extract solution into contact with the polymer containing, in its side chain, a functional group which traps metal ions including at least magnesium. As the polymer used, a polymer which has, in its side chain, a functional group which traps magnesium by chelation is preferred. An example of such a functional group includes an iminodiacetic acid group. A particularly preferable polymer in the present invention is a polymer having a repeating unit represented by the following formula:

[Chem 1]

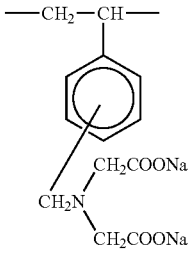

Such a polymer is commercially available (for example, DIAION CR-11 available from Mitsubishi Chemical Corporation). This polymer has a granularity in a range of 300 to 1180 μm and an apparent density of 730 g/L.

The polymer used in the present invention is insoluble in water.

The polymer noted above is capable of trapping metals such as calcium, potassium, etc. in addition to magnesium. By using the polymer, it is possible to eliminate magnesium significantly from the tobacco extract solution while suppressing the loss of other components such as nicotine, saccharides, amino acids and proteins to a minimum degree The amount of polymer used may differ depending on the type of the polymer. In the case of a polymer having the above-described repeating unit, the amount is preferably 20 g or less with respect to 100 mL of the extract solution. If more than 20 g of the polymer is used per 100 mL of the extract solution, the components other than the metal ions may be significantly eliminated. More preferably, the amount of the polymer used is 8 g or less with respect to 100 mL of the extract solution. Further, the amount of the polymer is preferably 4 g or more with respect to 100 mL of the extract solution.

The temperature, at which the extract solution and the polymer are contacted, is not particularly limited, and they can be contacted at a temperature higher than the freezing temperature of the extract solution but lower than its boiling point.

In this manner, the extract solution with magnesium significantly eliminated can be obtained.

It should be noted that the filtrate obtained by the filtration after the extraction of the natural tobacco material contains substances having relatively high molecular weights such as proteins and starches as described above, and these substances may deteriorate the polymer's metal eliminating effect. Therefore, it is preferable that the filtrate is subjected to a centrifugal separation to separate it into a supernatant and precipitates, and the polymer is added to the supernatant. Since the precipitates obtained after the centrifugal separation contain components necessary for the flavor of the tobacco, they can be added to a regenerated tobacco together with the supernatant treated with the polymer.

Next, a method of manufacturing a regenerated tobacco material according to the present invention will be described.

The above-described extraction residue obtained by the extraction of the natural tobacco material with the aqueous extracting solvent, followed by the separation operation, substantially consists of fibers. Using this extraction residue, a regenerated tobacco web is manufactured by an ordinary method. The regenerated tobacco web may be partially constituted by the extraction residue, or it may be entirely constituted by the extraction residue.

Then, the magnesium-eliminated extract solution is concentrated or not concentrated, and at least a portion thereof is added to the regenerated tobacco web. Thus, a desired regenerated tobacco material is obtained. A cigarette manufactured by using this regenerated tobacco material has significantly reduced amounts of benzopyrene, HCN, acrolein, nitrogen oxide (NOx), aminonaphthalene, etc. in the smoke generated when smoked.

The present invention will be described below by way of Examples.

EXAMPLES

Preparation of Tobacco Shreds 1000 mL of deionized water was added to 100 g of flue-cured tobacco leaf shreds, and the extraction was conducted by shaking at 20° C. for 30 minutes, and the mixture was filtered using a Teflon (registered trademark) mesh having an opening diameter of 0.75 mm, thereby obtaining a filtrate and extraction residue. The obtained extraction residue was dried.

On the other hand, the filtrate was subjected to a centrifugal separation (3000 rpm for 10 minutes), thereby obtaining a supernatant and precipitates. To the supernatant, a chelating resin (DIAION CR-11 available from Mitsubishi Chemical Corporation) was added in an amount of 0.8 g/10 mL, which was shaken at 20° C. for 30 minutes, and then allowed to stand still, thus obtaining a supernatant. The supernatant was combined with the precipitates obtained by the centrifugal separation, which was then freeze-dried. The freeze-dried material was dissolved in deionized water, which was sprayed uniformly onto the above-noted dried extraction residue, and thus tobacco shreds were prepared.

Further, the filtrate as obtained directly from the extraction process was uniformly sprayed onto the regenerated web above, which was cut to prepare control tobacco shreds.

<Manufacture of Cigarette>

The tobacco shreds prepared as above were respectively adjusted in moisture for 48 hours in a conditioning room maintained at room temperature (22° C.) and a relative humidity of 60%. Then, with a small cigarette making machine (available from RIZLA UK), cigarettes having a tobacco shred weight of 700 mg, a length of 59 mm and a circumference of 25 mm was manufactured.

<Analysis of Main Components in Tobacco Shreds>

The analysis of the main components in the tobacco shreds was carried out in the following manner.

(a) Metals, Inorganic Acids and Acids 1 g of tobacco shreds was extracted with 10 mL of deionized water by shaking (25° C. for 30 minutes), and filtered with a 0.45 am polytetrafluoroethylene (PTFE) filter. Metals (Mg, Ca and K), inorganic acids (phosphate ions, chloride ions and sulfate ions), organic acids (malic acid and citric acid) contained in the filtrate were quantitatively determined with a capillary electrophoresis device (available from Agilent Technologies).

(b) Nicotine

Nicotine in the tobacco shreds was quantitatively determined by the method of analyzing the components in tobacco shreds, defined in Document A (Official Methods made by the Department of Health (Canada), dated Dec. 31, 1999).

(c) Saccharides 1 g of tobacco shreds was extracted with 10 mL of deionized water by shaking (25° C. for 30 minutes), and filtered with a 0.45 μm PTFE filter. Saccharides (glucose and fructose) contained in the filtrate were quantitatively determined with a high-performance liquid chromatography (HPLC).

Analytical instrument used . . . HPLC 1100 series (reverse phase) available from Agilent.

Analytical conditions . . . Column: Carbohydrate Cartridge (250×4.6 mm); Mobile phase: Gradient of acetone and water; Detector: Differential refractometer; Determination: Absolute calibration curve method.

(d) Amino Acids 1 g of tobacco shreds was extracted with 10 mL of deionized water by shaking (25° C. for 30 minutes), and filtered with a 0.45 μm PTFE filter. Amino acids contained in the filtrate were quantitatively determined with an amino acid autoanalyzer (JLC-50 available from JEOL).

<Analysis of Components in Mainstream Smoke)

(I) Smoking Conditions

The cigarettes were burnt under the standard smoking conditions defined by the ISO method. Specifically, the cigarettes were smoked on an automatic smoking machine with puff duration of 2 seconds, puff interval of 1 minute, and puff volume of 35 mL until a cigarette butt length of 23 mm, and the mainstream smoke was collected.

(II) Method of Analyzing Components in the Mainstream Smoke

HCN, benzopyrene (B[a]P), acrolein, NOx and 2-aminonaphthalene in the mainstream smoke were analyzed in the following manner based on the method of analyzing the components in the mainstream smoke, defined in the above-mentioned document A.

(a) HCN

The mainstream smoke of two cigarettes was collected with one impinger containing a glass fiber filter and 30 mL of a 0.1 N sodium hydroxide solution. The tar-containing filter was extracted with 30 mL of a 0.1 N sodium hydroxide solution by shaking for 30 minutes, and then the extract was filtered with a 0.45 μm PTFE filter. Cyanide ions contained in the filtrate and the impinger solution were calorimetrically analyzed with an autoanalyzer (BRAN+LUBBE), and thus HCN in the mainstream smoke was quantitatively determined.

(b) Acrolein

The mainstream smoke of two cigarettes was collected with one impinger (cooled with ice) containing 100 mL of a 2,4-DNPH acidic acetonitrile solution. The collected liquid was allowed to stand at room temperature for 60 to 90 minutes, and filtered with a 0.45 μm PTFE filter. Then, 4 mL of 1% tirizma base liquid was added to 6 mL of the filtrate, and then the acrolein was quantitatively determined with HPLC.

Analytical instrument used . . . HPLC 1100 series (reverse phase) available from Agilent Technologies.

Analytical conditions . . . Column: Merck Lichrospher RP-18e; Mobile phase: Gradient of acetonitrile, deionized water, tetrahydrofuran and isopropanol; Detector: UV; Determination: Absolute calibration curve method.

(c) B[a]P

The mainstream smoke of two cigarettes was collected with a glass fiber filter. The amount of crude tar per one cigarette was calculated from the measurement of the change in weight of the filter. The tar-containing filter was extracted with cyclohexane by shaking (extracted with 1 mL of the solvent per 1 mg of crude tar) for 30 minutes, and the extract was filtered with a 0.45 μm PTFE filter. Then, the filtrate was charged on Sep-Pak Plus NH2 Cartridge (WATERS), and the liquid collected with hexane was evaporated to dryness under nitrogen at 50° C. The dried material was dissolved in 1 mL of acetonitrile, and B[a]P was quantitatively determined with HPLC.

Analytical instrument used . . . HPLC 1100 series (reverse phase) available from Agilent Technologies.

Analytical conditions . . . Column: YOKOGAWA Excelpak SIL-C18 3A; Mobile phase: Gradient of deionized water; Detector: FLD; Determination: Absolute calibration curve method.

(d) NOx

The mainstream smoke of one cigarette was passed through a glass fiber filter and introduced into a chemiluminescence detector (CLM-500 available from Simazu), and NOx in the mainstream smoke was quantitatively determined.

(e) 2-aminonaphthalene

The mainstream smoke of two cigarettes was collected with a glass fiber filter. The tar-containing filter was extracted with 30 mL of a 5% hydrochloric acid solution by shaking for 30 minutes, and then the extract was filtrated with a 0.45 μm PTFE filter. The filtrate was transferred to a separating funnel, and an internal standard liquid was added. Then, the mixture was washed three times with dichloromethane. To the aqueous layer, a 50% sodium hydroxide solution was added to adjust the pH to 12 or higher. The aqueous layer was extracted with hexane, and the extract was dehydrated with sodium sulfate and was acylated with trimethylamine and PFPA (pentafluoropropionic anhydride). This material was charged on Florisil SPE Column (SPELCO), and the liquid collected with a mixed liquid of hexane/benzene/acetone (5/4/1 (volume ratio)) was concentrated to 1 mL under nitrogen at 38° C. Then, 2-aminonaphthalene was quantitatively determined with a mass spectrometry gas chromatography (GC-MS).

Analytical instrument used . . . HPLC 1100 series (reverse phase) available from Agilent.

Analytical conditions . . . SIM mode; Column: HP-5MS 0.25 μm thickness; Determination: Internal standard method.

With use of the above-described methods, each cigarette was measured at three times of repetition, and the average amount of the component per cigarette and the standard deviation were calculated. Relative value (%) of each component when the component in the control was set at 100 was calculated and the statistical significant difference was studied using the t-test.

The results of the analysis on the components in the prepared tobacco shreds are indicated in TABLE 1.

TABLE 1

| Components | | Component amount (mg/g of tobacco shreds) | |
|---|---|---|---|
| | | Control | Invention |
| Metals | Mg | 3.6 | 0.8 |
| | Ca | 4.0 | 0.7 |
| | K | 21.3 | 9.2 |

TABLE 1-continued

| Components | | Component amount (mg/g of tobacco shreds) | |
|---|---|---|---|
| | | Control | Invention |
| Alkaloids | Nicotine | 22.3 | 18.1 |
| Saccharides | Glucose | 34.2 | 34.1 |
| | Fructose | 52.0 | 51.0 |
| Amino acids | Total amino acid | 11.6 | 11.4 |
| Organic acids | Malic acid | 37.4 | 34.3 |
| | Citric acid | 4.0 | 3.8 |
| Inorganic acids | Phosphate ions | 4.9 | 4.3 |
| | Chloride ions | 3.3 | 3.1 |
| | Sulfate ions | 7.3 | 6.8 |

As is indicated in TABLE 1, Mg, Ca and K were eliminated by 78%, 82% and 57%, respectively, by the treatment with the chelating resin, but the other components such as nicotine and saccharides were eliminated only by about 0 to 10%.

Next, the results of the analysis on the components in the mainstream smoke are indicated in TABLE 2.

TABLE 2

| | Relative component value in mainstream smoke (%) | | | | |
|---|---|---|---|---|---|
| | B[a]P | HCN | Acrolein | NOx | 2-amino-naphthalene |
| Per cigarette | 69* | 43* | 76* | 49* | 82* |
| Per TPM | 87* | 48* | 84* | 57* | 90 |

Note)
*Data for which statistical significant difference ($P < 0.05$) was recognized In the cigarette to which the extract solution treated with the chelating resin was added, B[a]P was decreased by 31%, HCN by 57%, acrolein by 24%, NOx by 51%, and 2-aminonaphthalene by 18% per cigarette as compared to those of the control. Further, in the comparison in terms of per crude tar (TPM), the component decreasing effect of about 10% to 50% was observed.

As described above, according to the present invention, magnesium can be eliminated effectively from a natural tobacco extract solution without significantly eliminating the other components including nicotine. Therefore, a regenerated tobacco material obtained by adding the magnesium-eliminated extract solution to a regenerated tobacco web manufactured using the extraction residue is remarkably suppressed in the generation of benzopyrene, hydrogen cyanide, acrolein, nitrogen oxide (NOx), aminonaphthalene, etc. in the mainstream smoke.

What is claimed is:

1. A method of treating a tobacco extract solution, comprising:

subjecting an extract solution, which is obtained by extracting a natural tobacco material with an aqueous extracting solvent, to a centrifugal separation to separate the extract solution into a supernatant and precipitates, wherein the supernatant contains metal ions including magnesium, calcium and potassium, inorganic acids, organic acids including amino acids, saccharides and nicotine and the precipitates include proteins and starches; and bringing the supernatant into contact with a polymer containing, in its side chain, a functional group which traps by chelation metal ions including at least magnesium, thereby obtaining an extract solution product with an amount of at least magnesium reduced, wherein the polymer has a repeating unit represented by a formula:

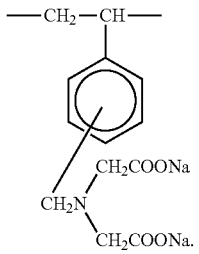

2. A method of manufacturing a treated tobacco material, comprising the steps of:

(a) extracting a natural tobacco material with an aqueous extracting solvent to obtain an extract solution containing components of the natural tobacco material and an extraction residue, wherein the extraction residue comprises fibers;

(b) subjecting the extract solution to a centrifugal separation to separate the extract solution into a supernatant and precipitates, wherein the supernatant contains metal ions including magnesium, calcium and potassium, inorganic acids, organic acids including amino acids, saccharides and nicotine and the precipitates include proteins and starches;

(c) bringing the supernatant into contact with a polymer containing, in its side chain, a functional group which traps, by chelation, metal ions including at least magnesium, thereby obtaining an extract solution product with an amount of at least magnesium reduced, wherein the polymer has a repeating unit represented by a formula;

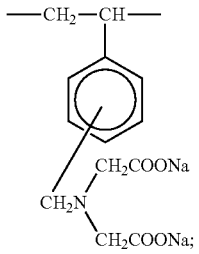

(d) preparing a tobacco web using the extraction residue; and (e) adding at least a portion of the extract solution product to the tobacco web.

3. The method according to claim 2, further comprising adding the precipitates to the tobacco web.

* * * * *